US005794112A

United States Patent [19]

Ray et al.

[11] Patent Number: 5,794,112

[45] Date of Patent: Aug. 11, 1998

[54] CONTROLLED ATMOSPHERE FOR FABRICATION OF CERMET ELECTRODES

[75] Inventors: Siba P. Ray, Murrysville; Robert W. Woods, New Kensington, both of Pa.

[73] Assignee: Aluminum Company of America, Pittsburgh, Pa.

[21] Appl. No.: 883,060

[22] Filed: Jun. 26, 1997

[51] Int. Cl.[6] ..... B22F 3/12

[52] U.S. Cl. ..... 419/21; 419/37; 419/38

[58] Field of Search ..... 419/21, 37, 38

[56] References Cited

U.S. PATENT DOCUMENTS 5,134,039 7/1992 Alexander et al. ..... 428/614

5,137,867 8/1992 Ray et al. ..... 505/1

5,160,366 11/1992 Shibata ..... 75/237

5,284,527 2/1994 Smeggil et al ..... 148/281

5,286,441 2/1994 Shibata ..... 419/21

5,312,582 5/1994 Donado ..... 419/19

*Primary Examiner*—Daniel J. Jenkins

*Attorney, Agent, or Firm*—Glenn E. Klepac

[57] ABSTRACT

A process for making an inert electrode composite wherein a metal oxide and a metal are reacted in a gaseous atmosphere at an elevated temperature of at least about 750° C. The metal oxide is at least one of the nickel, iron, tin, zinc and zirconium oxides and the metal is copper, silver, a mixture of copper and silver or a copper-silver alloy. The gaseous atmosphere has an oxygen content that is controlled at about 5–3000 ppm in order to obtain a desired composition in the resulting composite.

16 Claims, 2 Drawing Sheets

CONTROLLED ATMOSPHERE FOR FABRICATION OF CERMET ELECTRODES

The Government has rights in this invention pursuant to Contract No. DE-FC07-89ID 12848 awarded by the Department of Energy.

FIELD OF THE INVENTION

The present invention relates to inert electrodes suitable for use in the electrolytic production of metals such as aluminum. More particularly, the invention relates to a process for making an inert electrode composite comprising a metal oxide phase and a metal phase.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. The use of a dimensionally stable inert anode together with a wettable cathode also allows efficient cell designs and a shorter anode-cathode distance, with consequent energy savings.

The most significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1000° C. It must be relatively inexpensive and should have good mechanical strength. It must have electrical conductivity greater than 120 $ohm^{-1}$ $cm^{-1}$ at the smelting cell operating temperature, about 950°–970° C. In addition, aluminum produced with the inert anodes should not be contaminated with constituents of the anode material to any appreciable extent.

Processes for making inert electrode materials are known in the prior art. However, the prior art processes generally suffer from serious deficiencies making them less than entirely suitable for their intended purpose.

A principal objective of our invention is to provide an efficient and economical process for making an inert electrode material.

A related objective of our invention is to provide a process for making an inert electrode composite, wherein the resulting product comprises a metal oxide phase and a metal phase.

Additional objectives and advantages of our invention will become apparent to persons skilled in the art from the following detailed description of some preferred embodiments.

SUMMARY OF THE INVENTION

The present invention relates to a process for making an inert electrode composite. Inert electrodes containing the composite material of our invention are useful in producing metals such as aluminum, lead, magnesium, zinc, zirconium, titanium, lithium, calcium, silicon and the like, generally by electrolytic reduction of an oxide or other salt of the metal.

In accordance with our invention, a mixture of particles is reacted in a gaseous atmosphere and at an elevated temperature. The mixture comprises at least one metal oxide and at least one metal. The metal oxide includes at least one oxide of a metal selected from nickel, iron, tin, zinc and zirconium. A mixture of nickel and iron oxides is preferred. The mixture preferably contains about 50–90 parts by weight of the metal oxide and about 10–50 parts by weight of the metal.

The metal in the mixture includes at least one metal selected from copper, silver, mixtures of copper and silver, and copper-silver alloys. Mixtures and alloys of copper and silver containing up to about 30 wt. % silver are preferred. The silver content will generally be about 5–30 wt. %, preferably about 5–20 wt. %.

The particulate mixture is reacted at an elevated temperature in the range of about 750°–1500° C., preferably about 1000°–1400° C. and more preferably about 1300°–1400° C. In a preferred embodiment, the reaction temperature is about 1350° C.

The gaseous atmosphere contains about 5–3000 ppm oxygen, preferably about 5–700 ppm and more preferably about 10–350 ppm. Lesser amounts of oxygen result in a product having a larger metal phase than is desired, and excessive oxygen results in a product having too much of the metal oxide phase. The remainder of the gaseous atmosphere preferably comprises a gas such as argon that is inert to the metal at the reaction temperature.

In a preferred embodiment, about 2–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the metal oxide and metal particles.

DETAILED DESCRIPTION OF A PREFERRED EMBODIMENT

Figure 1:
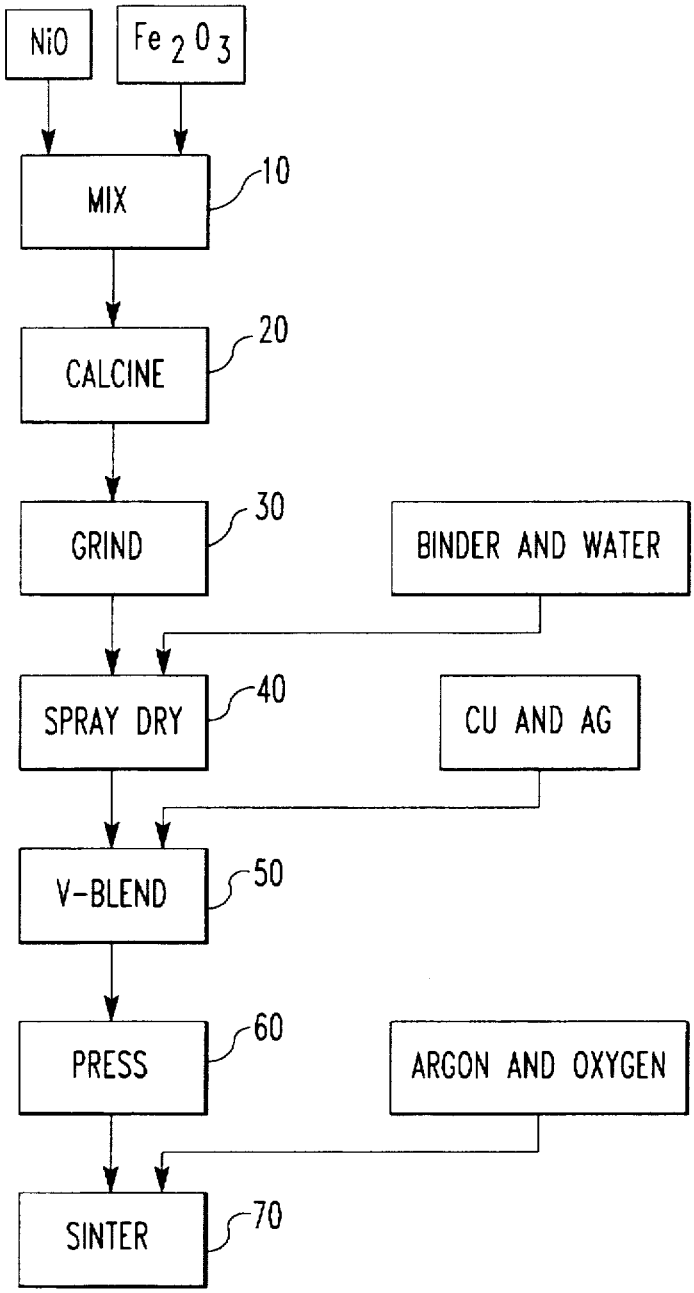
FIG. 1 is a flowsheet diagram of a process for making an inert electrode composite in accordance with the present invention.

In the particularly preferred embodiment diagrammed in FIG. 1, the process of our invention starts by blending NiO and $Fe_2O_3$ powders in a mixer 10. Optionally, the blended powders may be ground to a smaller size before being transferred to a furnace 20 where they are calcined for 12 hours at 1250° C. The calcination produces a mixture having spinel and NiO phases.

The mixture is sent to a ball mill 30 where it is ground to an average particle size of approximately 10 microns. The fine particles are blended with a polymeric binder and water to make a slurry in a spray dryer 40. The slurry contains about 60 wt. % solids and about 40 wt. % water. Spray drying the slurry produces dry agglomerates that are transferred to a V-blender 50 and there mixed with copper and silver powders.

The V-blended mixture is sent to a press 60 where it is isostatically pressed, for example at 20,000 psi, into anode shapes. The pressed shapes are sintered in a controlled atmosphere furnace 70 supplied with an argon-oxygen gas mixture. The furnace 70 is typically operated at 1350°–1385° C. for 2–4 hours. The sintering process burns out polymeric binder from the anode shapes.

The starting material in a particularly preferred embodiment of our process is a mixture of copper powder with a metal oxide powder containing about 51.7 wt. % NiO and about 48.3 wt. % $Fe_2O_3$. The copper powder nominally has a 10 micron particle size and possesses the properties shown in Table 1.

TABLE 1

Physical and Chemical Analysis of Cu Powder

| | Particle Size (microns) |
|---|---|
| 90% less than | 27.0 |
| 50% less than | 16.2 |
| 10% less than | 7.7 |

Spectrographic Analysis
Values accurate to a factor of ±3

| Element | Amount (wt. %) |
|---|---|
| Ag | 0 |
| Al | 0 |
| Ca | 0.02 |
| Cu | Major |
| Fe | 0.01 |
| Mg | 0.01 |
| Pb | 0.30 |
| Si | 0.01 |
| Sn | 0.30 |

Figure 2:
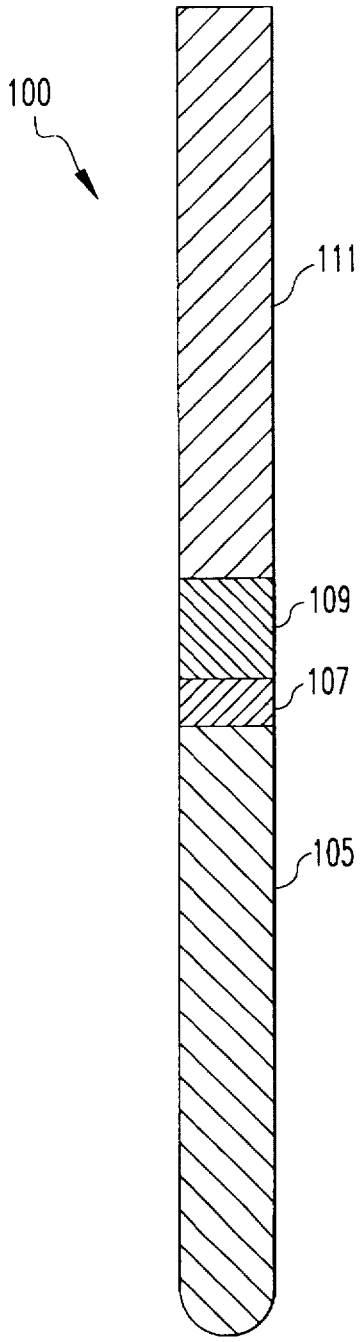
FIG. 2 is a schematic illustration of an inert anode made in accordance with the present invention.

About 83 parts by weight of the NiO and $Fe_2O_3$ powders are combined with 17 parts by weight of the copper powder. As shown in FIG. 2, an inert anode 100 of the present invention includes a cermet end 105 joined successively to a transition region 107 and a nickel end 109. A nickel or nickel-chromium alloy rod 111 is welded to the nickel end 109. The cermet end 105 has a length of 96.25 mm, the transition region 107 is 7 mm long and the nickel end 109 is 12 mm long. The transition region 107 includes four layers of graded composition, ranging from 25 wt. % Ni adjacent the cermet end 105 and then 50, 75 and 100 wt. % Ni, balance the mixture of NiO, $Fe_2O_3$ and copper powders described above.

The anode 10 was pressed at 20,000 psi and then sintered in an argon atmosphere. Oxygen content of the argon atmosphere was not measured. Anodes produced under these conditions had porosities in the range of 0.5–2.8%, and the anodes also showed various amounts of bleed out of the copper rich metal phase.

We have discovered that sintering anode compositions in an atmosphere of controlled oxygen content lowers the porosity to acceptable levels and avoids bleed out of the metal phase. The atmosphere we used in tests summarized below was predominantly argon, with controlled oxygen contents in the range of 17 to 350 ppm. The anodes were sintered in a Lindbergh tube furnace at 1350° C. for 2 hours. We found that anode compositions sintered under these conditions always had less than 0.5% porosity, and that density was approximately 6.05 g/cm$^3$ when the compositions were sintered in argon containing 70–150 ppm oxygen. Data in Table 2 show the effect of oxygen concentration on density and porosity of the anode.

TABLE 2

Porosity and Density as a Function of Oxygen Content

| Oxygen Content (ppm) | Porosity (%) | Average Porosity (%) | Density (g/cm$^3$) | Average Density (g/cm$^3$) |
|---|---|---|---|---|
| 350 | 0.133 | 0.133 | 4.998 | 5.998 |
| 250 | 0.133 | 0.133 | 6.019 | 6.019 |
| 150 | 0.121 | | 6.033 | |
| 150 | 0.149 | 0.119 | 6.051 | 6.045 |
| 150 | 0.086 | | 6.051 | |
| 90 | 0.068 | | 6.053 | |
| 90 | 0.144 | | 6.046 | |
| 90 | 0.071 | | 6.059 | |
| 90 | 0.145 | 0.116 | 6.048 | 6.050 |
| 90 | 0.145 | | 6.044 | |
| 90 | 0.082 | | 6.058 | |
| 90 | 0.141 | | 6.043 | |
| 90 | 0.130 | | 6.053 | |
| 75 | 0.160 | 0.149 | 6.045 | 6.046 |
| 75 | 0.138 | | 6.047 | |
| 70 | 0.117 | | 6.043 | |
| 70 | 0.105 | | 6.037 | |
| 70 | 0.0997 | | 6.043 | |
| 70 | 0.032 | 0.088 | 6.056 | 6.048 |
| 70 | 0.099 | | 6.050 | |
| 70 | 0.074 | | 6.048 | |
| 70 | 0.093 | | 6.057 | |
| 19 | 0.051 | | 5.937 | |
| 19 | 0.611 | 0.300 | 5.911 | 5.926 |
| 19 | 0.239 | | 5.929 | |
| 17 | 0.070 | | 5.918 | |
| 17 | 0.108 | 0.069 | 5.948 | 5.922 |
| 17 | 0.028 | | 5.964 | |
| 17 | 0.068 | | 5.859 | |

We also measured metal content in the anode metal phase, for anodes sintered in 70 and 90 oxygen atmospheres at 1350° C. Data in Table 3 show copper contents of 78–81 wt. %, nickel contents 18–20 wt. % and iron contents of 2–3 wt. % in 70 and 90 ppm oxygen.

TABLE 3

Metal Phase Content as a Function of Oxygen Content in the Sintering Atmosphere

| Oxygen Content | Metal Content (wt. %) | | |
|---|---|---|---|
| (ppm) | Cu | Ni | Fe |
| 90 | 78 | 20 | 2 |
| 90 | 80 | 18 | 3 |
| 90 | 78 | 20 | 3 |
| 90 | 81 | 18 | 2 |
| 90 | 80 | 18 | 2 |
| 70 | 79 | 19 | 2 |
| 70 | 80 | 19 | 2 |

We also discovered that nickel and iron contents in the metal phase of our anode compositions can be increased by adding an organic polymeric binder to the sintering mixture. A portion of the nickel and iron oxides in the mixture is reduced to form an alloy containing copper, nickel and iron. Some suitable binders include polyvinyl alcohol (PVA), acrylic acid polymers, polyglycols such as polyethylene glycol (PEG), polyvinyl acetate, polyisobutylenes, polycarbonates, polystyrenes, polyacrylates and mixture and copolymers thereof.

A series of tests was performed with a mixture comprising 83 wt. % of metal oxide powders and 17 wt. % copper powder. The metal oxide powders were 51.7 wt. % NiO and 48.3 wt. % $Fe_2O_3$. Various percentages of organic binders were added to the mixture, which was then sintered in a 90 ppm oxygen-argon atmosphere at 1350° C. for 2 hours. The results are shown in Table 4.

TABLE 4

Effect of Binder Content on Metal Phase Composition

| Binder | Binder Content (wt. %) | Metal Phase Composition Fe (wt. %) | Ni (wt. %) | Cu (wt. %) |
|---|---|---|---|---|
| 1 PVA | 1.0 | 2.16 | 7.52 | 90.32 |
| Surfactant | 0.15 | | | |
| 2 PVA | 0.8 | 1.29 | 9.2 | 89.5 |
| Acrylic Polymers | 0.6 | | | |
| 3 PVA | 1.0 | 1.05 | 10.97 | 87.99 |
| Acrylic Polymers | 0.9 | | | |
| 4 PVA | 1.1 | 1.12 | 11.97 | 86.91 |
| Acrylic Polymers | 0.9 | | | |
| 5 PVA | 2.0 | 1.51 | 13.09 | 85.40 |
| Surfactant | 0.15 | | | |
| 6 PVA | 3.5 | 3.31 | 32.56 | 64.13 |
| PEG | 0.25 | | | |

The foregoing detailed description of our invention has been made with reference to some particularly preferred embodiments. Persons skilled in the art will understand that numerous changes and modifications can be made therein without departing from the spirit and scope of the following claims.

What is claimed is:

1. A process for making an inert electrode composite suitable for use in production of a metal by electrolytic reduction of a metal compound comprising:

(a) reacting in a gaseous atmosphere and at an elevated temperature a mixture of particles comprising:

(i) at least one metal oxide selected from the group consisting of nickel, iron, tin, zinc and zirconium oxides, and (ii) at least one metal selected from the group consisting of copper, silver, mixtures of copper and silver, and copper-silver alloys; and (b) controlling said atmosphere so that it contains about 5–3000 ppm oxygen.

2. The process of claim 1 further comprising:

(c) compressing said mixture at a pressure of at least about 1000 psi before step (a).

3. The process of claim 1 wherein said atmosphere further comprises a gas inert to said metal at said elevated temperature.

4. The process of claim 1 wherein said metal oxide comprises nickel and iron oxides.

5. The process of claim 1 wherein said metal includes a mixture or alloy of copper and silver containing up to about 30 wt. % silver.

6. The process of claim 1 wherein said metal comprises about 70–95 wt. % copper and about 5–30 wt. % silver.

7. The process of claim 1 wherein said mixture comprises about 50–90 wt. % of the metal oxide and about 10–50 wt. % of the metal.

8. The process of claim 7 wherein said mixture further comprises about 2–10 wt. % of an organic polymeric binder.

9. The process of claim 8 wherein said mixture comprises about 3–6 wt. % of said binder.

10. The process of claim 8 wherein said binder is selected from the group consisting of polyvinyl alcohol, acrylic acid polymers, polyvinyl acetate, polyisobutylenes, polycarbonates, polystyrenes, polyacrylates, polyglycols and mixtures and copolymers thereof.

11. The process of claim 1 wherein said elevated temperature is in the range of about 750°–1500° C.

12. The process of claim 1 wherein said elevated temperature is in the range of about 1000°–1400° C.

13. The process of claim 1 wherein said elevated temperature is in the range of about 1300°–1400° C.

14. The process of claim 1 wherein said atmosphere contains about 5–700 ppm oxygen.

15. The process of claim 1 wherein said atmosphere contains about 10–350 ppm oxygen.

16. The process of claim 1 wherein said process results in a composite comprising a metal oxide phase and a metal phase, said metal phase comprising about 70–90 wt. % copper, about 8–20 wt. % nickel and about 0.4–4 wt. % iron.

* * * * *